US008387535B1

(12) United States Patent
Guirguis et al.

(10) Patent No.: US 8,387,535 B1
(45) Date of Patent: Mar. 5, 2013

(54) HYDROREACTIVE ENERGETIC DEVICE AND METHOD

(75) Inventors: Raafat Guirguis, Faifax, VA (US); Carl Gotzmer, Accokeek, MD (US); Steven Kim, Crofton, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 189 days.

(21) Appl. No.: 12/802,457

(22) Filed: May 14, 2010

(51) Int. Cl.
*F42B 3/08* (2006.01)

(52) U.S. Cl. ..... 102/315

(58) Field of Classification Search ..... 102/314, 102/399, 416, 315, 320, 322, 325, 327, 332, 102/406
See application file for complete search history.

(56) References Cited

U.S. PATENT DOCUMENTS

| | | | | | |
|---|---|---|---|---|---|
| 830,056 | A * | 9/1906 | Dowd | 102/205 |
| 3,598,051 | A * | 8/1971 | Avery | 102/305 |
| 4,188,884 | A | 2/1980 | White et al. | |
| 4,280,409 | A * | 7/1981 | Rozner et al. | 102/364 |
| H464 | H * | 5/1988 | Lee et al. | 102/364 |
| 4,815,385 | A * | 3/1989 | Kingery et al. | 102/320 |
| 4,950,460 | A * | 8/1990 | Goodwin et al. | 422/239 |
| 5,212,343 | A | 5/1993 | Brupbacher et al. | |
| 5,450,794 | A | 9/1995 | Drimmer | |
| 6,131,518 | A * | 10/2000 | Hains | 102/406 |
| 6,354,220 | B1 | 3/2002 | Graham et al. | |
| 6,736,069 | B2 | 5/2004 | Kim | |
| 7,059,250 | B1 | 6/2006 | Sutherland et al. | |
| 7,156,024 | B2 * | 1/2007 | Ronn et al. | 102/489 |
| 7,468,484 | B1 * | 12/2008 | Yatsenko | 114/20.1 |
| 8,250,981 | B1 * | 8/2012 | Gotzmer et al. | 102/314 |

* cited by examiner

*Primary Examiner* — Jonathan C Weber
(74) *Attorney, Agent, or Firm* — Fredric J. Zimmerman

(57) ABSTRACT

An explosive event may be produced by mixing reactive material and water to form a mixture. The reactive material may be mixed with a substantially stoichiometric amount of water needed for complete reaction of the water with the reactive material. After forming the mixture, the mixture may be detonated with opposing shock waves. Shock fronts of the opposing shock waves may coincide to form a mach front or mach stem, which may enhance the explosive effect.

10 Claims, 1 Drawing Sheet

HYDROREACTIVE ENERGETIC DEVICE AND METHOD

STATEMENT OF GOVERNMENT INTEREST

The invention described herein may be manufactured and used by or for the Government of the United States of America for Governmental purposes without the payment of any royalties thereon or therefor.

FIELD OF THE INVENTION

The invention relates, in general, to explosives, and, in particular, to underwater explosives.

BACKGROUND OF THE INVENTION

Combining reactive materials (RM) with water may produce shock energy and bubble energy. The chemical energy of an underwater explosion may be distributed into shock and bubble performance, as well as waste energy. The shock and the bubble produced by an underwater explosion may each contribute to the performance of the explosive event. A shock wave may initiate the decomposition of a high energy explosive, causing a release of gases and energy. The release of gases and energy may initiate the chemical decomposition of an oxidizer into a gas that drives the early expansion of a bubble.

Subsequently, the energy released from the fuel reacting with the product gases may be generally slow and may contribute to the bubble performance. If the expanding mixture is heavy in solids, the conversion of the chemical energy to potential energy of the bubble may be inefficient and may lead to waste energy in the form of hot gases at the end of the bubble expansion. If the expanding mixture is mostly gases, then the peak pressure may be high, but the shock wave may only be supported for a short time and, the energy from gas-producing reactions may be generally less than the energy from fuel-oxidizer reactions.

The conversion of chemical energy to potential energy of a bubble may be generally very efficient, leaving no waste energy in the form of hot gases at the end of the bubble expansion. Thus, increasing the energy release from intimate fuel-oxidizer (RM/H2O) combinations early in the bubble expansion process may increase the rate of oxidizer decomposition and, therefore, the shock performance. The rapid, early time-frame bubble expansion may generate a shock wave out into the water. The shock wave may very quickly outpace the expanding bubble. Enhanced shock performance may result from increasing the early time-frame rate of bubble expansion and sustaining the rate of bubble expansion as long as possible.

SUMMARY OF THE INVENTION

An aspect of the invention is a method that may include mixing reactive material and water to form a mixture, and, after forming the mixture, detonating the mixture with opposing shock waves. The reactive material may be mixed with a substantially stoichiometric amount of the water needed for complete reaction of the water with the reactive material. After detonating, the coincidence of opposing shock fronts of the opposing shock waves may form a mach front.

Another aspect of the invention is an apparatus that may include a closed container with explosive material disposed at opposite ends of the closed container. A second container containing reactive material may be disposed in the closed container. The closed container may include a valve for connecting to an ambient water supply. The second container may include an opener for opening the second container. A control unit may be connected to the valve, the opener, and the explosive material.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE INVENTION

A reactive material ("RM") is an energetic material having two or more solid-state reactants that together form a thermochemical mixture. RM may include, for example, mixtures of metals with metals and mixtures of metals with metal oxides. The mixtures may or may not include binders. Some examples of RM are ultra-fine powders, such as nano-aluminum; and self-propagating high-temperature synthesis (SHS) materials, such as thermites, intermetallics, nano-metals, micro-size metals, etc. RM may be pre-mixed with water, prior to detonation, to realize shock energy, bubble energy, and impulse.

Prior to detonation, RM and water may be mixed to form a mixture. In some embodiments, the mixture may contain the stoichiometric amount of water needed for complete reaction of the water with the RM. Some embodiments may include a mixture where the RM has a density that is greater than about 2.0 grams per cubic centimeter, or greater than about 2.5 grams per cubic centimeter.

After mixing, the mixture may then be detonated. Detonation of the mixture may occur soon after mixing. In some embodiments, the mixture may be detonated within about ten minutes of, mixing, within about five minutes of mixing, or within about a minute of mixing.

Two opposing explosives may be used to detonate the mixture. The two opposing explosives may each produce opposing shock waves. The two shock waves may propagate through the mixture of RM and water, thereby detonating the mixture. The two opposing shock fronts may coincide or fuse near the middle of the mixture, forming a mach stem or mach front. Formation of the mach front may increase the temperature, pressure, and turbulent mixing of the mixture.

Physically confining the reaction may cause the two opposing shock waves to be reflected inwardly, thereby increasing the energy released. Therefore, a closed container may contain the mixture prior to detonation. The water needed for the mixture may be introduced into the closed container from the ambient environment. For example, if the container is in a body of water, such as an ocean, river, lake, etc, then water from the body of water surrounding the container may be used in the mixture. In this way, it may not be necessary to transport the water (oxidizer) with the RM.

Figure 1:
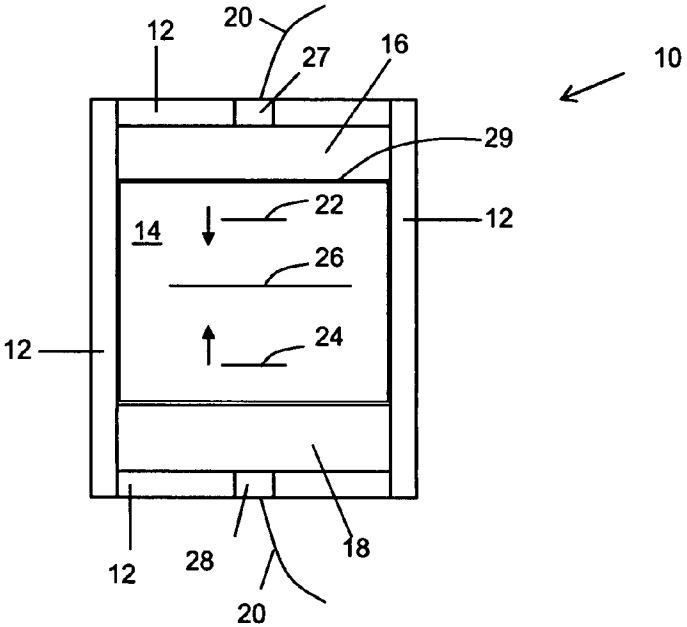
FIG. 1 is a schematic drawing of an embodiment of a hydroreactive energetic apparatus.

FIG. 1 is a schematic drawing of an embodiment of a hydroreactive energetic apparatus 10. Apparatus 10 may include a closed container 12 and explosives 16, 18 located at opposite ends of the container 12. A mixture 14 of RM and water may be disposed in a second container 29, between the explosives 16, 18. The mixture 14 may contain the stoichiometric amount of water needed for complete reaction of the water with the RM. Wires 20 or other means may be used to carry a detonation signal to detonators 27, 28. Detonators 27, 28 may detonate explosives 16, 18, respectively. In some embodiments, container 12 may be substantially cylindrical.

Detonation of the explosives 16, 18 may produce opposing shock waves 22, 24. Shock waves 22, 24 may propagate from the ends of container 29 and through mixture 14, thereby detonating mixture 14. The shock fronts of the shock waves may coincide near the middle 26 of container 29 to form a mach front or mach stem. The mach front or mach stem may increase the explosive output of the mixture 14.

Figure 2:
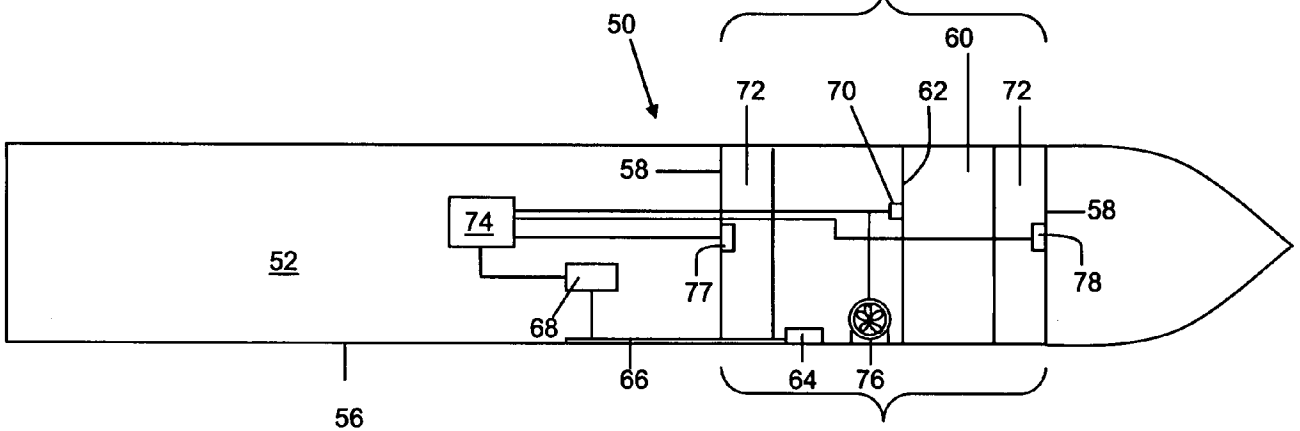
FIG. 2 is a schematic drawing of another embodiment of a hydroreactive energetic apparatus.

FIG. 2 is a schematic drawing of another embodiment of a hydroreactive energetic apparatus 50. Apparatus 50 may be a warhead disposed in, for example, a torpedo 52. Apparatus 50 may include a closed container 54 that may be defined by, for example, exterior surfaces 56 and interior bulkheads 58 of torpedo 52. Container 54 may be, for example, substantially cylindrical. Explosive material 72 may be disposed at opposite ends of container 54. Detonators 77, 78 may be disposed in or adjacent the explosive material 72. A quantity of RM 60 may be disposed in container 54. RM 60 may be confined in, for example, another container 62.

A valve 64 in container 54 may lead directly to the outside of torpedo 52, or may, as shown in FIG. 2, be connected to tubing or piping 66 that may lead to the outside of torpedo 52. A water pump 68 may be used to introduce water from outside the torpedo 52 into container 54 via piping 66 and valve 64. The amount of water introduced into the container 54 may be the stoichiometric amount of water needed for complete reaction of the water with the RM 60.

The RM container 62 may be rupturable by an opener 70. Opener 70 may be, for example, a small quantity of energetic material. An agitator 76 may be disposed in container 54 for mixing the RM 60 and water. A control unit 74 may be connected to the valve 64, the opener 70, and the detonators 77, 78. The control unit 74 may include a processor and power supply. The control unit 74 may also be connected to the pump 68 and agitator 76.

When the torpedo 52 nears its target, valve 64 may open and introduce water into container 54. Or, the pump 68 may be used to pump water into container 54. The opener 70 may be activated to open container 62 so that the RM 60 may mix with the water. The agitator 76 may be activated to insure thorough mixing of the RM 60 and water. Just prior to impact of the torpedo 52 with its target, explosive material 72 located at opposite ends of container 54 may be initiated by detonators 77, 78. Initiation of the explosive material 72 may produce opposing shock waves that emanate from the opposite ends of container 54. The reaction then proceeds as previously described.

If explosive material 72 is chosen to be compliant with Insensitive Materials (IM) requirements, then the overall hydroreactive energetic apparatus may be compliant with IM requirements and may yield a more powerful energetic material configuration than conventional arrangements. The hydroreactive energetic apparatus may not require the use of ammonium perchlorate or explosive components such as PBXN-103 and PBXN-111. Apparatus that utilize ammonium perchlorate may, in some cases, not comply with IM or environmental requirements.

The disclosed method may mix RM with water quickly enough to produce shock impulse. Because the RM and water is mixed prior to detonation, the problems of quenching of the shock-heated particles by the water, and a reaction time that is too long to realize shock impulse, may be avoided.

Any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An apparatus, comprising:

a closed container;

explosive material being disposed at opposite ends of the closed container;

reactive material being disposed in a second container, the second container is disposed in the closed container;

a valve in the closed container for connecting to an ambient water supply;

an opener for the second container; and a control unit being connected to the valve, the opener, and the explosive material.

2. The apparatus of claim 1, wherein the closed container is substantially cylindrical.

3. The apparatus of claim 1, further comprising a pump fluidly being connected to the valve.

4. The apparatus of 1, wherein the opener for the second container includes energetic material.

5. The apparatus of claim 1, further comprising an agitator being disposed in the substantially closed container and being connected to the control unit.

6. The apparatus of claim 1, wherein the reactive material comprises a density greater than about 2.0 grams per cubic centimeter.

7. The apparatus of claim 6, wherein the reactive material comprises a density greater than about 2.5 grams per cubic centimeter.

8. A warhead comprising the apparatus of claim 1.

9. A torpedo comprising the apparatus of claim 1.

10. The torpedo of claim 9, wherein of a portion of the closed container includes an exterior surface of the torpedo.

* * * * *